US012546186B2

(12) United States Patent
Randle et al.

(10) Patent No.: US 12,546,186 B2
(45) Date of Patent: Feb. 10, 2026

(54) ELECTRICALLY ACTIVATED DOWNHOLE VALVE FOR DRILLING APPLICATIONS

(71) Applicant: Dynomax Drilling Tools Inc., Leduc (CA)

(72) Inventors: Hartley Randle, Spruce Grove (CA); Brandon Jullion, Beaumont (CA); Joshua Gamble, Spruce Grove (CA)

(73) Assignee: Dynomax Drilling Tools Inc., Leduc (CA)

( * ) Notice: Subject to any disclaimer, the term of this patent is extended or adjusted under 35 U.S.C. 154(b) by 0 days.

(21) Appl. No.: 18/178,388

(22) Filed: Mar. 3, 2023

(65) Prior Publication Data

US 2024/0141750 A1 May 2, 2024

(30) Foreign Application Priority Data

Oct. 28, 2022 (CA) ..... CA 3180354

(51) Int. Cl.

| | |
|---|---|
| ***E21B 34/06*** | (2006.01) |
| ***E21B 7/24*** | (2006.01) |
| ***E21B 21/10*** | (2006.01) |
| ***E21B 28/00*** | (2006.01) |

(52) U.S. Cl.

CPC ..... *E21B 34/066* (2013.01); *E21B 7/24* (2013.01); *E21B 21/10* (2013.01); *E21B 28/00* (2013.01)

(58) Field of Classification Search

CPC ..... E21B 34/066; E21B 7/24; E21B 28/00; E21B 21/10; E21B 4/02; E21B 31/005; E21B 43/003

See application file for complete search history.

(56) References Cited

U.S. PATENT DOCUMENTS

| | | | |
|---|---|---|---|
| 4,058,163 | A | 11/1977 | Yandell |
| 4,768,598 | A | 9/1988 | Reinhardt |
| 4,819,745 | A | 4/1989 | Walter |
| 4,890,682 | A | 1/1990 | Worrall et al. |
| 4,979,577 | A | 12/1990 | Walter |
| 6,279,670 | B1 | 8/2001 | Eddison et al. |
| 6,431,294 | B1 | 8/2002 | Eddison et al. |
| 6,439,318 | B1 | 8/2002 | Eddison et al. |
| 7,139,219 | B2 | 11/2006 | Kolle et al. |

(Continued)

FOREIGN PATENT DOCUMENTS

| | | |
|---|---|---|
| CA | 2872736 C | 1/2015 |

OTHER PUBLICATIONS

Non-final Office Action dated Jan. 6, 2026, in connection U.S. Appl. No. 19/192,148, 10 pages.

*Primary Examiner* — Robert E Fuller

(57) ABSTRACT

There is a downhole valve for use in a standpipe. A valve body defines a flow path through the valve body. A valve poppet within the valve body is axially movable in a direction parallel with the standpipe when in use. An electrically activated linear activation system is connected to the valve poppet to move the valve poppet axially. The flow through the flow path varies as the valve poppet is moved axially. There is a method of activating a downhole valve for use in a standpipe. A condition downhole is detected using a sensor. The downhole valve is electrically activated based on the detected condition downhole. The valve and method may be used to turn on and off a vibration tool when a drill string is in the horizontal section of a well.

25 Claims, 11 Drawing Sheets

(56) References Cited

U.S. PATENT DOCUMENTS

| | | | |
|---|---|---|---|
| 7,523,792 | B2 | 4/2009 | El-Rayes et al. |
| 7,757,781 | B2 | 7/2010 | Hay et al. |
| 8,162,078 | B2 | 4/2012 | Anderson |
| 8,167,051 | B2 | 5/2012 | Eddison et al. |
| 9,004,194 | B2 | 4/2015 | Eddison et al. |
| 9,091,123 | B2 | 7/2015 | Gust |
| 9,598,923 | B2 | 3/2017 | Gilleylen et al. |
| 9,637,976 | B2 | 5/2017 | Lorenson et al. |
| 9,765,584 | B2 | 9/2017 | Lorenson et al. |
| 9,932,774 | B2 | 4/2018 | Gillis |
| 10,465,464 | B2 | 11/2019 | Campbell |
| 10,619,437 | B2 | 4/2020 | Lorenson et al. |
| 10,648,265 | B2 | 5/2020 | Kinsella et al. |
| 10,677,006 | B2 | 6/2020 | von Gynz-Rekowski et al. |
| 10,829,993 | B1 | 11/2020 | von Gynz-Rekowski et al. |
| 10,927,601 | B2 | 2/2021 | Lorenson et al. |
| 10,968,721 | B2 | 4/2021 | Lorenson et al. |
| 10,989,004 | B2 | 4/2021 | Russell et al. |
| 11,002,099 | B2 | 5/2021 | Clausen et al. |
| 2005/0115714 | A1* | 6/2005 | Millet ..... E21B 34/066 166/319 |
| 2005/0257931 | A1 | 11/2005 | Mody et al. |
| 2011/0036631 | A1 | 2/2011 | Prill et al. |
| 2014/0246234 | A1* | 9/2014 | Gillis ..... E21B 44/00 175/24 |
| 2015/0260014 | A1* | 9/2015 | Zimmerman ..... E21B 47/18 166/66.5 |
| 2015/0337652 | A1 | 11/2015 | Rodney |
| 2018/0149002 | A1* | 5/2018 | Murdoch ..... E21B 47/06 |
| 2020/0011146 | A1 | 1/2020 | Samuel |
| 2021/0262340 | A1 | 8/2021 | Moody |
| 2022/0003063 | A1 | 1/2022 | Switzer et al. |
| 2022/0034165 | A1 | 2/2022 | Espinoza et al. |
| 2023/0296013 | A1 | 9/2023 | Lanning et al. |
| 2024/0141750 | A1 | 5/2024 | Randle et al. |

* cited by examiner

ELECTRICALLY ACTIVATED DOWNHOLE VALVE FOR DRILLING APPLICATIONS

CROSS-REFERENCE TO RELATED APPLICATIONS

This application is based on and claims priority under 35 U.S.C. 119 to Canadian Application No. 3,180,354, filed on Oct. 28, 2022, in the Canadian Patent Office, the disclosure of which is herein incorporated by reference in their entirety.

TECHNICAL FIELD

This relates to valves used with tools in the drilling of oil and gas wells.

BACKGROUND

Many downhole tools operate based on fluid pressure. By diverting or altering a flow path through a tool, various systems and functions can be activated or deactivated. Sometimes this can be accomplished through fully mechanical means, such as dropping a ball from surface into a ball seat or having a spring that allows a sleeve to travel and block/unblock a flow path based on the pressure or amount of flow.

The downside of such activation devices is that they either only allow for a single "on" activation, or they limit the available flow parameters in either the "on" or "off" position. It is advantageous to have an activation system that can both activate and deactivate a system that is not directly tied to fluid flowrate, or a mechanical spring.

When drilling oil and gas wells, a directional approach to drilling is often employed, where the first section of the well is vertical, and the subsequent section is lateral (or horizontal). Drilling the horizontal section has various challenges. A significant challenge is to effectively transfer the weight of the drill string in the vertical section to the drill bit in the horizontal section. Friction created as the drill string advances through the horizontal section can cause difficulties. One method to aid in the weight transfer is through the use of an axial vibration tool, where one or multiple tools are placed in various locations throughout the string, and help to break the wellbore friction by imparting vibration to the drillstring.

It is often beneficial to not have the vibration tool activate until it has reached the lateral section of the wellbore. This can be beneficial for several reasons, including preventing damage to casing, and extending the life of the components by only operating as needed.

Several current methods exist for activating such an assembly, many of which are based on dropping a projectile from the surface in order to modify the flow path through the tool and activate the valve. Often these methods are a simple "on" switch, with no ability to turn the tool off, and the drilling string must be tripped out of hole in order to remove the projectile and reset the tool. This can be a major inconvenience when drilling a well with multiple "legs" or lateral sections.

SUMMARY

There is disclosed in one embodiment a method of activating a linear valve in order to divert or alter the fluid path through a tool in response to a measured or transmitted stimuli.

There is disclosed in one embodiment a method of activating a rotary valve in a downhole tool through an electronically powered apparatus in response to a downhole measurement or pre-set activation criterion.

There is disclosed in one embodiment a downhole valve for use in a standpipe. There is a valve body having a flow path through the valve body. A valve poppet is axially movable within the valve body in a direction parallel with the standpipe when in use. An electrically activated linear activation system is connected to the valve poppet to move the valve poppet axially. The flow through the flow path varies as the valve poppet is moved axially.

In various embodiments, there may be included any one or more of the following features: one or more openings in the valve body are at least partially covered by the valve poppet when the valve poppet is moved axially; the flow path comprises at least two flow paths and in which the axial movement of the valve poppet varies the amount of flow through each of the at least two flow paths; a sensor for detecting a condition downhole, and a processor which operates the valve poppet in response to the condition detected; a battery connected to the sensor and the processor; the linear activation system further comprises an electric motor and a ball screw; the downhole valve is installed within a vibration tool for use during drilling; the valve poppet comprises tungsten carbide; the valve body comprises tungsten carbide; the sensor is one or more of an accelerometer, a magnetometer, a pressure sensor or a thermocouple; there is a gear box between the electric motor and the ball screw; the flow path further comprises a first flow path in fluid connection with a passage between a rotor and a stator, and a second flow path in fluid connection with a bore in the rotor; and all of the at least two flow paths are contained within the standpipe.

There is disclosed in one embodiment a downhole valve for use in a standpipe. There is a valve body having a flow path. A valve positioner is moveable relative to the valve body to vary flow through the flow path. An electrically activated linear activation system is connected to the valve positioner to move the valve positioner relative to the valve body. There is a sensor for detecting a condition downhole and a processor configured to move the valve positioner relative to the valve body to vary flow through the flow path in response to the condition detected.

In various embodiments, there may be included any one or more of the following features: the sensor is one or more of: an accelerometer, a magnetometer, a pressure sensor or a thermocouple.

There is disclosed in one embodiment an activation system for a downhole valve. A rotary driving device converts fluid pressure to rotary motion. A rotary valve has one or more openings connected to the rotary driving device and a stationary component with one or more openings. Rotation of the rotary valve varies alignment of the one or more openings of the rotary component relative to the one or more openings of the stationary component thereby varying flow through the rotary valve. A bypass passage defines a flow path through the rotary valve. An electrically activated assembly operates a bypass valve to vary an amount of flow through the bypass passage.

In various embodiments, there may be included any one or more of the following features: a sensor for detecting a condition downhole, and a processor configured to move the bypass valve in response to the condition detected; the processor moves the bypass valve in response to a measured parameter reaching a pre-set value; the rotary driving device is a rotor operating based on the principles of a Moineau pump; the bypass passage further comprises a bore through the rotor; the rotary driving device is a turbine; the rotary valve has a portion that is always open through a full rotation relative to the stationary component; the electrically activated assembly further comprises an electric motor coupled to a ball screw to create linear motion; the bypass valve is a poppet valve; the sensor is one or more of an accelerometer, a magnetometer, a pressure sensor, a flow sensor or a thermocouple.

There is disclosed in one embodiment a method of activating a downhole valve for use in a standpipe. A condition downhole is detected using a sensor. The downhole valve is electrically activated based on the detected condition downhole.

In various embodiments, there may be included any one or more of the following features: the detected condition downhole is indicative that the standpipe is in a horizontal section of a well; the downhole valve comprises: a valve body having a flow path through the valve body, a valve poppet within the valve body being axially movable in a direction parallel with the standpipe when in use, in which electrically activating the downhole valve further comprises activating an electrically activated linear activation system connected to the valve poppet to electrically activate the valve poppet to move axially, and in which the flow through the flow path varies as the valve poppet is moved axially; the sensor is one or more of an accelerometer, a magnetometer, a pressure sensor or a thermocouple; the downhole valve comprises: a valve body defining a flow path, a valve positioner moveable relative to the valve body to vary flow through the flow path, and in which electrically activating the downhole valve further comprises activating an electronically activated activation system connected to the valve positioner to move the valve positioner relative to the valve body; the downhole valve is used to activate a vibration tool; the downhole valve further comprises: a rotary valve having one or more openings connected to a rotary driving device and a stationary component with one or more openings, in which rotation of the rotary valve varies alignment of the one or more openings of the rotary component relative to the one or more openings of the stationary component thereby varying flow through the rotary valve, and a bypass valve to vary the amount of flow through a bypass passage defining a flow path through the rotary valve; and applying the method to activate a vibration tool in a drilling operation. These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figure 1:
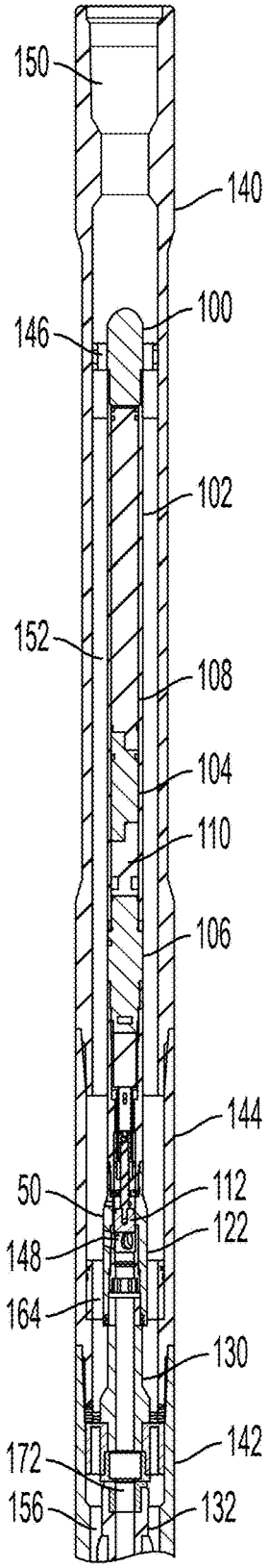
FIG. 1 is a cross-section of an activation device having a valve according to one embodiment.

As shown in FIG. 1, there is an activation device 50 within an assembly with a series of housings 140, 144, and 142 that separates an internal fluid path 150, often referred to as the standpipe from the external fluid path, or annulus, of the drilling string. The internal fluid path 150 is uninterrupted through the housing and progresses through the centralizer 100 that holds the electronics package in the center of the housing 140. A pressure sleeve 102 holds a battery 108, sensor package 104, snubber 110 and is connected to the motor bulkhead 106. The area within the centralizer and around the pressure sleeve 146 and 152 forms part of the continuous fluid path.

The sensor package could also have a receiver, for receiving wireless transmissions for activation/deactivation, alternatively or additionally it could contain one or more of an accelerometer, magnetometer, pressure sensor, or thermocouple. The sensor can detect a condition downhole, and a processor may operate the valve poppet in response to the condition detected. In a preferred embodiment, the sensor may include an accelerometer and a magnetometer to determine an inclination setting using the processor. In other embodiments, mechanical and/or pressure switches could be used without a processor, which would have a simpler design but would be less precise and more complicated to turn off. The battery may be connected to the sensor and the processor. Other power sources can be used. For example, a turbine 400 (FIG. 14) could be used as a power source, which would be able to harness power from the fluid flow within the system. Below the motor bulkhead 106 are further components that will be detailed in later figures.

The sensor package allows for the operation of an electronically activated valve based on conditions downhole. Various types of valves can be used with the sensor package. In one embodiment of a downhole valve for use in a standpipe shown in FIGS. 2 and 3, there may be a valve body 122 defining a flow path and a valve positioner, for example, valve poppet 112, that is moveable relative to the valve body to vary flow through the flow path. The downhole valve may be any one of various types of valves, including a rotary valve, a poppet valve or other valve that can be activated based on readings of the sensors. An electrically activated linear activation system is connected to the valve positioner to move the valve positioner relative to the valve body. The sensor detects a condition downhole and the processor is configured to move the valve positioner relative to the valve body to vary flow through the flow path in response to the condition detected. The operation of the valve may activate a vibration tool or other downhole tool by diverting flow to or from the downhole tool. For example, the valve may direct flow either through a bypass passage or through the valve of a vibration tool to turn the vibration tool on or off. Optionally, the valve may incrementally vary the amount of flow between the bypass passage and the valve of the vibration tool to vary the magnitude of vibrations created by the vibration tool. In another embodiment, the operation of the valve may activate an activated reamer. In general, embodiments of the electrically activated downhole valve described herein may be used to activate any type of downhole tool which can be fluid activated and for which it is desirable for the tool to be predictably activated or deactivated.

Figure 2:
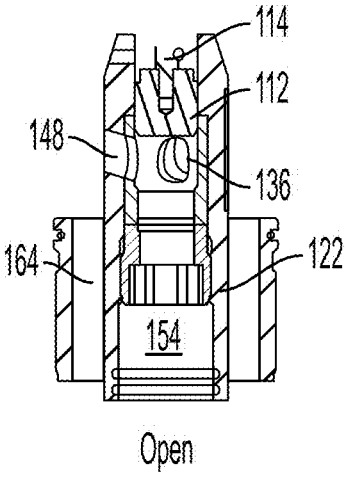
FIG. 2 is a cross-section of the valve of FIG. 1 having a valve poppet in an open position.
Figure 3:
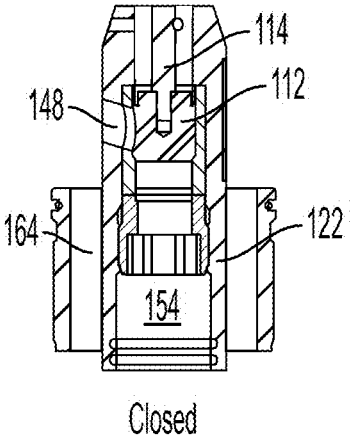
FIG. 3 is a cross-section of the valve poppet of FIG. 2 in a closed position.

As shown in FIGS. 2 and 3, the valve body 122 has one or multiple openings 136 that split the fluid path into an internal flow path 154 or an external flow path 164 and 156. The valve poppet 112 is located within the valve body 122, and can close off the internal fluid path that is composed of a wash tube 130 and potentially various other components below 132. An interface 172 seals the bore for the activation unit. In embodiments where the activation device is attached to a vibration tool having a rotor and a stator, the interface 172 forms part of the rotary to stationary interface and keeps the electronics stationary and the rotor rotational. Since the rotor has an eccentric rotation, two carbide plates may be used for the interface and seal.

The valve body 122 and valve poppet 112 collectively define a downhole valve that is installed in the standpipe. The valve body 122 has a flow path through the valve body. The valve poppet 112 sits within the valve body 122 and is axially movable in a direction parallel with the standpipe when in use. It will be understood that the valve poppet 112 being moveable in a direction parallel to the standpipe does not mean that the poppet moves exactly parallel to the axis of the standpipe, but that the substantial direction of movement of the poppet is along the axis of the drill string at the location of the valve in the drill string.

The electronics package includes an electrically activated linear activation system connected to the valve poppet 112 to move the valve poppet axially. The linear activation system may include an electric motor and a ball screw. Other mechanisms may be used to electrically activate the valve poppet.

FIGS. 2 and 3 show the valve poppet 112 in its two nominal positions, open or closed, respectively. The flow through the flow path varies as the valve poppet is moved axially.

In the open position in FIG. 2, the poppet rod 114 is retracted, thereby exposing the valve body's internal fluid path 148, and allowing flow through one or more openings 136 to the washpipe through the path 154. The one or more openings in the valve body are at least partially covered by the valve poppet when the valve poppet is moved axially into the closed position. Various different configurations of openings and flow paths can be used. The size and location of the flow paths can control the size of the vibrations that can be generated in a vibration tool. When the valve is in the open position, flow may pass through both the internal fluid path and the external flow path 164.

In the closed position in FIG. 3, the poppet rod 114 is extended, thereby positioning the valve poppet 112 directly in the valve body's internal fluid path 148, and preventing through flow. This causes the entirety of the flow to progress through the outside fluid path 164.

The open position may be partially or fully open and allow fluid flow through the valve body's internal flow path 148. The closed position may be partially or fully closed and allow reduced or no flow through the valve body's internal flow path 148. As shown in FIGS. 2 and 3, the flow path through the valve body comprises at least two flow paths, one through the valve body's internal flow path 148 and the other into the washpipe flow path 154 and the axial movement of the valve poppet varies the amount of flow through each of the at least two flow paths. In some embodiments, the flow path modified by the downhole valve includes a first flow path in fluid connection with a passage between a rotor and a stator, and a second flow path in fluid connection with a bore in the rotor. In some embodiments, all of the at least two flow paths are contained within the standpipe, meaning that the valve operates to create vibration using positive pressure within the system rather than negative pressure.

Figure 4:
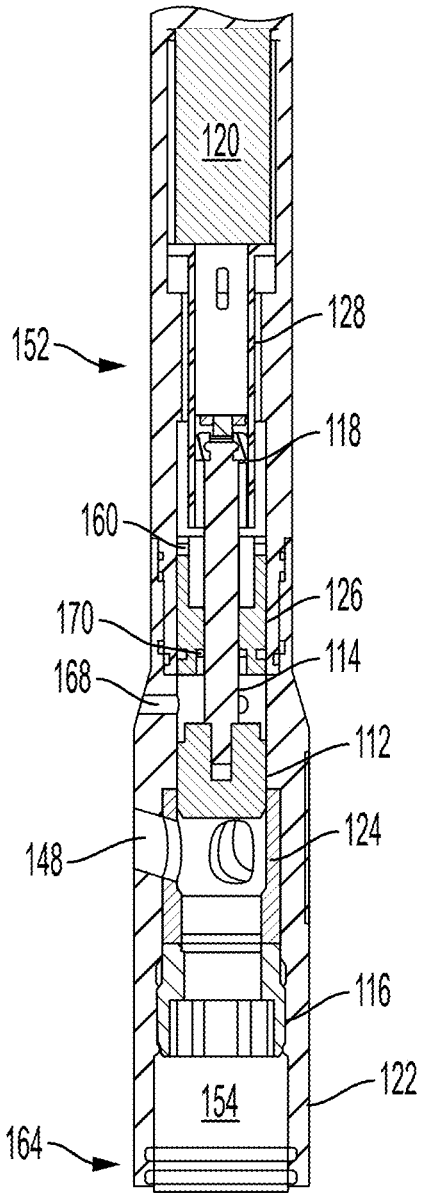
FIG. 4 is a cross-section of the activation system of the activation device of FIG. 1.

FIG. 4 shows further details of the activation system. The motor bulkhead contains a motor 120 and a ball screw 128 that is coupled through coupling 118 to the poppet rod 114. The bulkhead additionally has a floating piston 126 that is pressure compensated to the standpipe through a port hole 168, and sealed against the bulkhead using o-rings 160 and against the poppet rod 114 using an o-ring or u-cup style seal 170. The bulkhead is filled with oil for the operation of the motor and ball screw. Additionally, a gear box could be located between the motor 120 and ball screw 128 by extending the motor bulkhead. A gearbox has the additional benefit of increasing the closing force that can be applied by the ball screw 128 through the poppet rod 114 onto the valve poppet 112.

The valve body 122 contains a valve seat 124 that can be made of a hard material such as tungsten carbide to receive the valve poppet 112 once the system is activated. Other hard materials can be used. The valve poppet may also be made from a hard material such as tungsten carbide or other hard material. Additionally a seat lock 116 is positioned below the valve seat 124 to ensure it does not come loose or rotate during operation. The downhole valve may be installed to activate a vibration tool during drilling. The hard material used in the system components could be other components with a hard-faced layer other than tungsten carbide such as welded tungsten carbide with matrix or other materials created through other processes such as surface hardening steel. In a preferred embodiment, the hard material is formed using sintered carbide components to prevent wash damage on the valve components.

Figure 5:
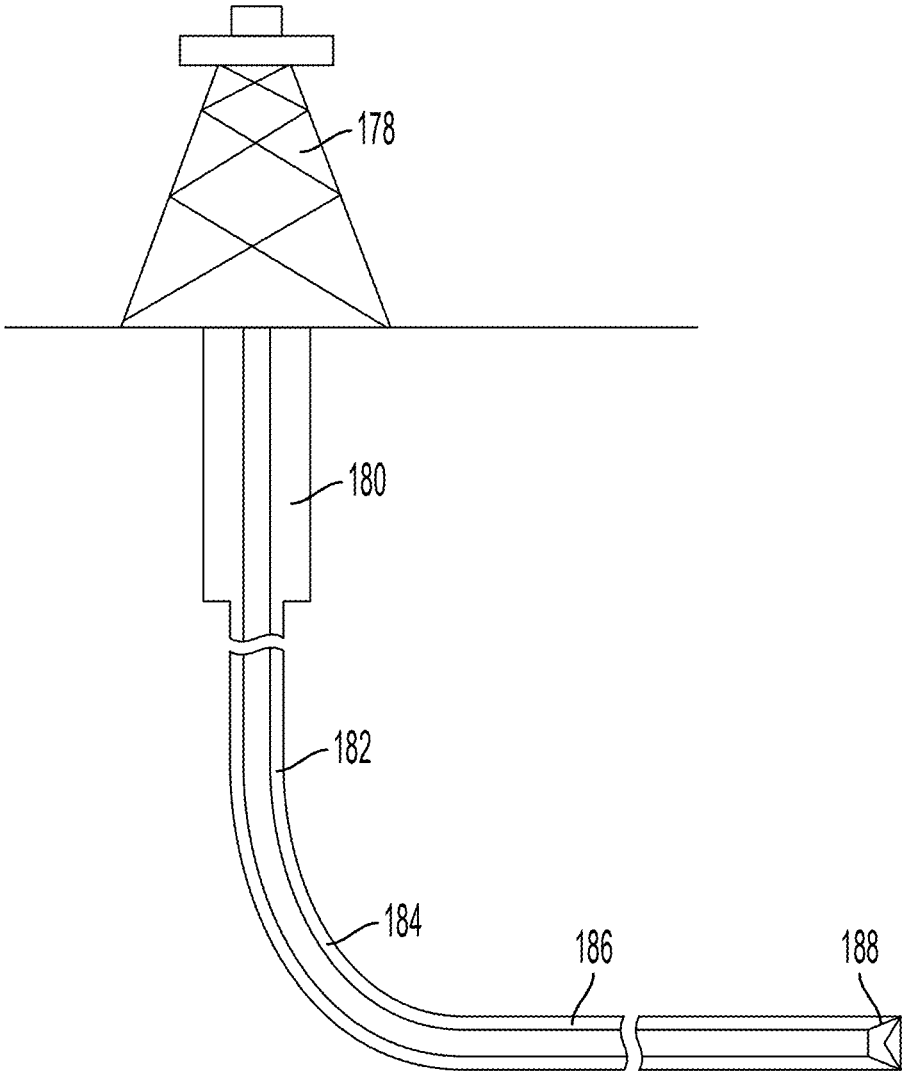
FIG. 5 is a schematic of a lateral well profile.

FIG. 5 shows an overview schematic of a lateral or deviated well plan for a drilling operation. A drilling rig 178 is installed at surface. In this embodiment, the vertical section of the well 180 is cased. In the following vertical section 182 and the curve 184, it is relatively easy to transfer the weight of the drill collar in the vertical section to the drill bit 188. However, as the lateral section of the well 186 extends, it can be very difficult to transfer weight to the drill bit 188. For this reason, vibration systems are employed which convert a pressure pulse into axial movement of the drill string. Although the horizontal portion of the well is shown as being level, a well bore may be described as horizontal despite not being precisely level. A horizontal portion of a wall may include a slight incline or slight decline relative to a precise measure of horizontal. However, it will be understood that a well bore that has a significant horizontal component may be described as being horizontal.

It is disadvantageous to have a vibration system that is always on, as the vibration can be damaging to the casing 180 when the system is activated inside of it. Instead, it is ideal to be able to activate the system "on-demand". When drilling a well with multiple lateral legs, the vibration system may be pulled back into the vertical cased section, so it is also advantageous to be able to turn the system "off" without having to trip and remove a mechanical activation device such as a ball or a dart.

The activation tools described herein provide for a method of activating a downhole valve for use in a standpipe. A condition downhole is detected using a sensor. The downhole valve is electrically activated based on the detected condition downhole. For example, the detected condition downhole is indicative that the standpipe is in a horizontal section of a well. The downhole valve may be used to activate a vibration tool during drilling, Various types of valves may be used to achieve this vibration, including any of the valve arrangements described herein.

Figure 6:
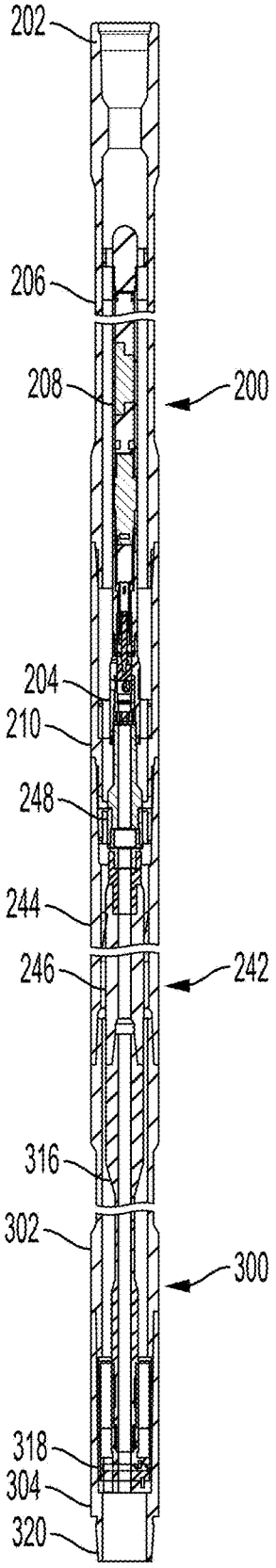
FIG. 6 is a cross-section of an activation device according to another embodiment.

As shown in in FIG. 6, the activation device includes an electronics assembly 200, a power section assembly 242 and a valve assembly 300, each assembly being composed of both housings 206, 210, 244, 302, 304 and internal components 208, 204, 246, 248, 316, 318. The housings have an uphole connection 202 which is designed to be threaded into the drillstring, and a lower connection 320 designed to be threaded into either the drillstring or a pressure responsive device such as a shock tool.

The electronics assembly 200 consists of two housings 206, 210 to facilitate assembly of the internal sonde 208 and bypass assembly 204 and to carry the loads transmitted through the drillstring.

Below the electronics assembly 200 is the power section assembly 242 which consists of a stator 244 and a rotor 246, as well as the rotary to stationary diverter assembly 248. This assembly contains the interface between the electronics assembly internals 208 and 204 which are stationary relative to the housing, and the rotor 246 which moves both rotational and eccentrically within the stator 244.

Then at the bottom of the tool is the valve assembly 300, which contains external housings 302 and 304 for facilitating assembly and to carry the drillstring loads, as well as an internal flexshaft 316 that connects the rotor 246 to the valve 318. Alternatively, the flex shaft could be replaced with a constant velocity joint.

Figure 7:
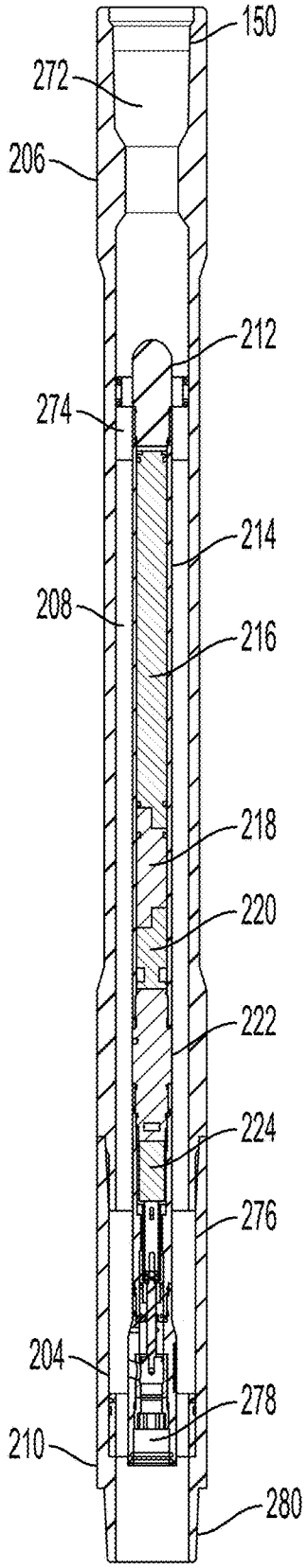
FIG. 7 is a cross-section of an electronics section of the activation device of FIG. 6.

The electronics assembly 200 is further detailed in FIG. 7.

The assembly is composed of two housings 206 and 210 for ease of assembly. The housings define an internal flow path 272. Inside the housings is a sonde 208 with a threaded mount on the downhole side, and a floating mount 212 on the uphole side. The floating mount 212 diverts the flow around the sonde. The sonde has a pressure housing 214 which contains a battery 216, a sensor and logic board or processor 218, and a snubber 220 for absorbing axial vibration. The pressure housing 214 connects to the motor bulkhead 222, which houses the motor and is attached to the ball screw 224 for increasing the closing power of the assembly. An electronics section 276 houses the electric motor, ball screw drive, and oil compensation piston. Outside of the electronics section is an internal flow path 274. A bore 278 has two o-rings to seal on a tube that goes to the rotary to stationary interface. The tube is allowed to move axially to accommodate changes of length of components. The axial movement of the tube allows for either tolerance stack up or component rework to fix damages. The base of the electronics assembly is a threaded connection 280.

Figure 8:
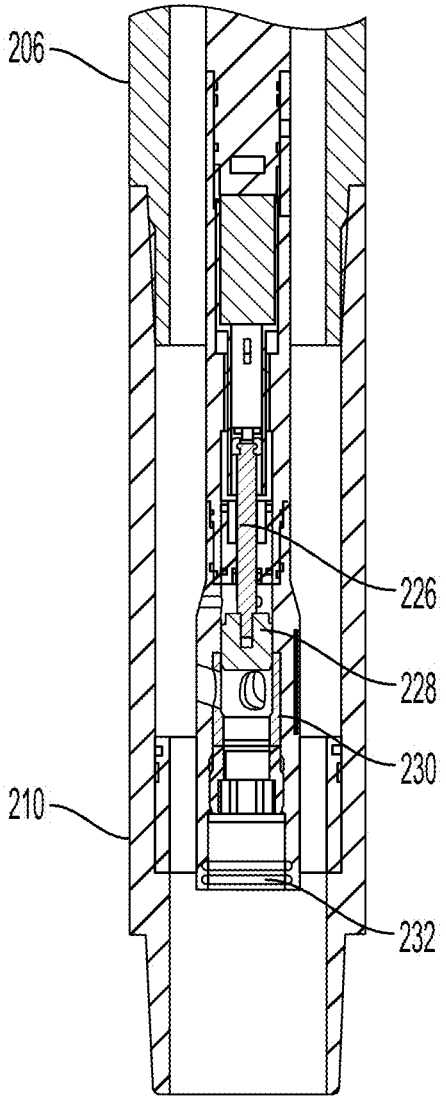
FIG. 8 is a cross-section of the activation device of FIG. 6 in a non-activated position.
Figure 9:
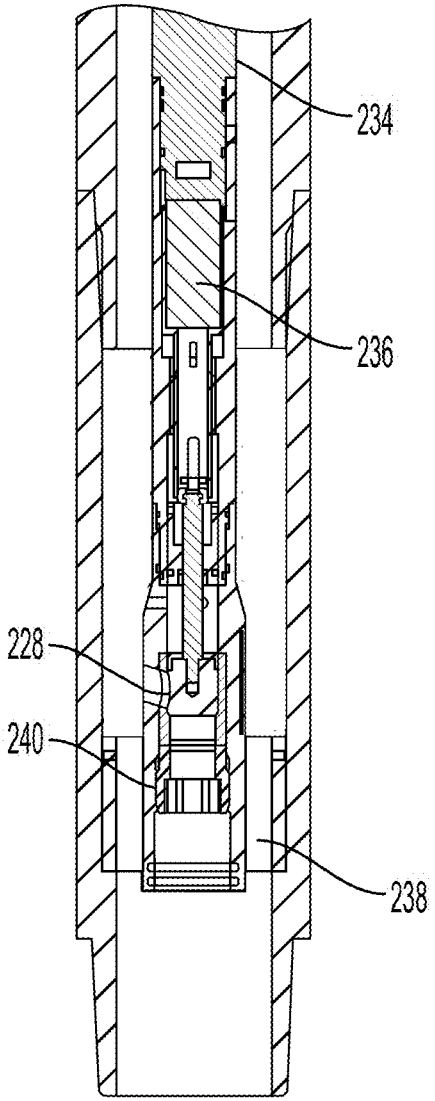
FIG. 9 is a cross-section of the activation device of FIG. 6 in an activated position.

Further details of the activation system are shown in FIGS. 8 and 9.

The bypass assembly has two nominal positions, open as shown in FIG. 8, and closed as shown in FIG. 9. The sonde contains the motor and motor bulkhead 234, which is connected to the ball screw 236. These components are not shown in detail but are commonly used in MWD pulser assemblies.

Below is the poppet rod 226, that is attached to the poppet head 228. The poppet rod 226 is driven by the motor 234 and ball screw 236, and changes position within the bypass sleeve 230. The bypass sleeve is held in place by the thread lock 240 to prevent it from moving axially or rotating relative to the bypass centralizer 238. When the bypass assembly has not been activated, flow is able to go through the outer flow path, through the outside of the bypass centralizer 238 or through the inner flow path of the bypass sleeve 230.

When the bypass assembly is activated, the poppet head 228 moves axially into the bypass sleeve 230, and thereby diverts 100% of the flow through the outer flow path around the bypass centralizer 230.

The power section assembly is connected to the lower end of the bypass centralizer 232 in such a way that it can be easily inserted after the electronics have been assembled. This allows for separate assembly of the electronics package from the rest of the tool.

Figure 10:
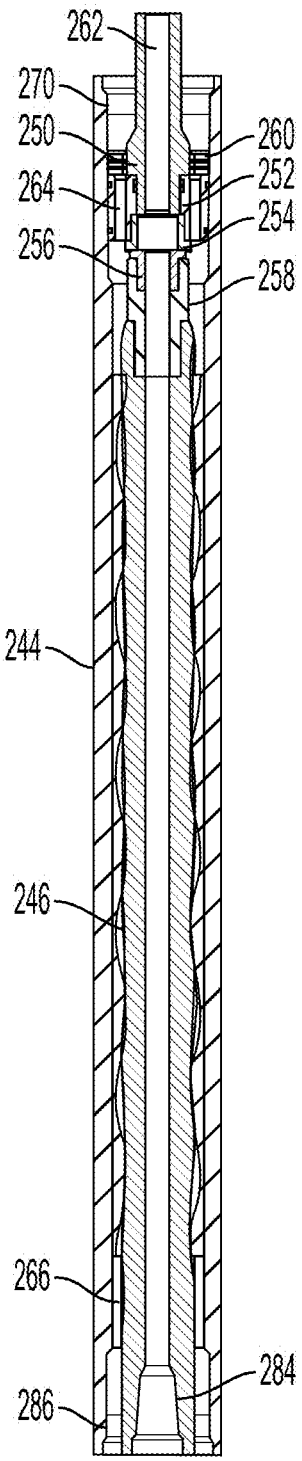
FIG. 10 is a cross-section of a power section assembly of the activation device of FIG. 6.

As shown in FIG. 10, the power section assembly 242 is primarily composed of an outer housing 244 called a stator, which is a steel tube with rubber bonded to the internal diameter. The rubber is profiled according to the principles of a Moineau pump, and has a corresponding rotor 246. A flow passage 266 is defined by the space between said rotor and stator. The rotor 246 also has a through bore 262 that allows fluid to flow through the assembly without entering the power section flow passage 266.

Additionally, the assembly has an upper thread 270 which connects to the housing of the electronics section, and a connecting tube 250 which can be inserted into the bypass centralizer 238 of the electronics assembly. This configuration allows for easy assembly of the electronics assembly 200 to the power section assembly 242.

The connecting tube 250 is inserted into the flow centralizer 252, which has an outer flow area 264 that leads to the power section flow passage 266. Pressed into the flow centralizer is a stationary orifice 254 that can be made of a hard material such as carbide and forms the stationary to rotary interface with the rotor 246. The rotor has a rotating orifice 256 pressed into an orifice adaptor 258 that is then threadedly connected to the rotor 246. The stationary orifice 254 is sized larger than the rotating orifice 256 so that even during the eccentric motion of the rotor 246 the flow path 262 is not restricted.

Additionally, a wave spring 260 which in alternate embodiments could also be a Belleville spring, preloads the stationary and rotating orifices against each other when the electronics housing 210 is threaded into the upper end of the stator 244. At the bottom of the power section assembly, connection 286 is a stator connection and connection 284 is a rotor connection.

Figure 11:
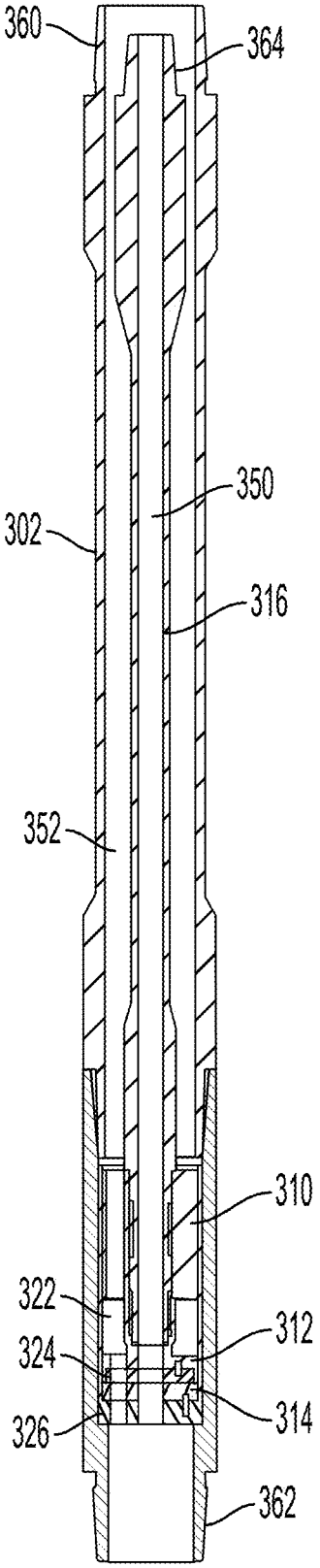
FIG. 11 is a cross-section of the valve assembly of the activation device of FIG. 6.

The valve section is shown in FIG. 11. In this embodiment, a flexshaft 316 is used to connect the rotor 246 to the valve assembly 318. This flexshaft contains a through bore 350 which once assembled is a continuation of the rotor through bore 262 shown in FIG. 10. Additionally, an outer flow path 352 exists around the outside of the flexshaft 316 and is a continuation of the power section flow path 266 from FIG. 10. The valve section has various connections 360, 362, 364.

The flexshaft 316 is then connected to a centralizer 310 to remove the eccentric motion of the rotor 246 before it reaches the valve assembly. The flexshaft 316 is also connected to the rotary valve holder 312 and rotary valve plate 324 which are defined by having a separate opening for each of the flow paths.

The housing 302 then contains an outer flow restrictor 322 which forms a mud lubricated journal bearing surface with the centralizer 310. Additionally, the stationary valve holder 326 and stationary valve plate 314 are pressed into the housing behind the outer flow restrictor 322. The rotary valve may have a portion that is always open through a full rotation relative to the stationary component. The stationary valve plate 314 and the rotary valve plate 324 have a through bore that is a continuation of the flexshaft through bore 350 that is always aligned regardless of the relative angle of the two plates. Various designs of rotary and stationary valve plates can be used. The specific layout of ports and/or the valve can vary depending on the tool design and the particular application.

The stationary 314 valve plate and rotary valve plate 324 also have one or multiple openings in line with the outer flow path 352 that will come into and out of alignment depending on the relative angle of the plates. It is generally advantageous to always have some percentage of the path open to prevent total cut-off of the flow through the outer flow path 352. As these plates rotate a variable pressure signal will be created that in combination with a responsive device (such as a shock tool) will impart an axial vibration to the drill string.

In this manner, the rotor 246 operates as a rotary driving device that converts fluid pressure to rotary motion. The rotary valve 324 has one or more openings connected to the rotary driving device and a stationary component 314 with one or more openings, and the rotation of the rotary valve varies alignment of the one or more openings of the rotary component relative to the one or more openings of the stationary component thereby varying flow through the rotary valve. There is a bypass passage 350 defining a flow path through the rotary valve and the rotor itself. The flow through the bypass passage is independent of the rotation of the rotor. An electrically activated assembly may be used to operate a bypass valve to vary an amount of flow through the bypass passage. The bypass valve may have various configurations and may be actuated electronically.

The processor may move the bypass valve in response to a measured parameter detected by the sensor reaching a pre-set value. The rotary driving device can be a device other than a rotor operating based on the principles of a Moineau pump. In other embodiments, the rotary driving device may be a turbine.

Figure 12:
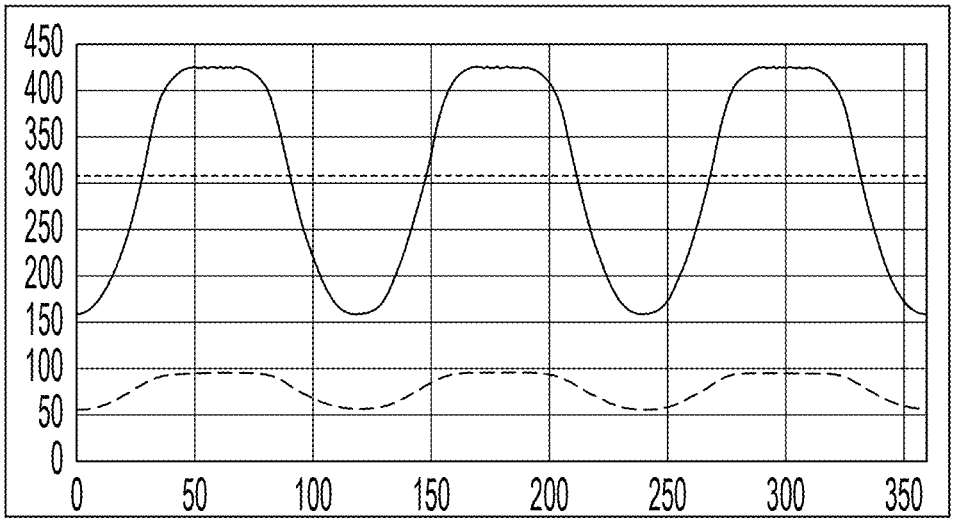
FIG. 12 is a chart showing the pressure signals when the valve is activated and not activated.

FIG. 12 shows the relative pressure drop of the tool shown in the embodiments in FIGS. 6-11 in the activated (upper line) and non-activated (lower line) states versus the relative angle of the rotary and stationary valve plates.

In the non-activated state, as the valve rotates it still produces a slight pressure pulse, but it is very minor compared with the activated pressure pulse (~6.5× less). As the area of the through bore is increased relative to the valve opening, the "off" pressure pulse will be reduced.

Additionally, many shock tools have a set preload, so that the shock tool will not travel unless the force applied on it exceeds the preload value. If the shock tool preload can be set to a greater value than the non-activated pressure pulse will produce on the tool, then no vibration will be created in the "off" position.

Figure 13:
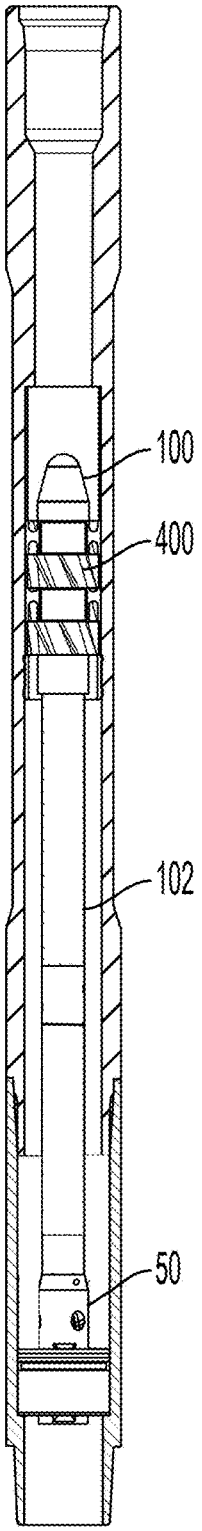
FIG. 13 is a partial cross-section of an electronics section of an embodiment of the activation device having a turbine.
Figure 14:
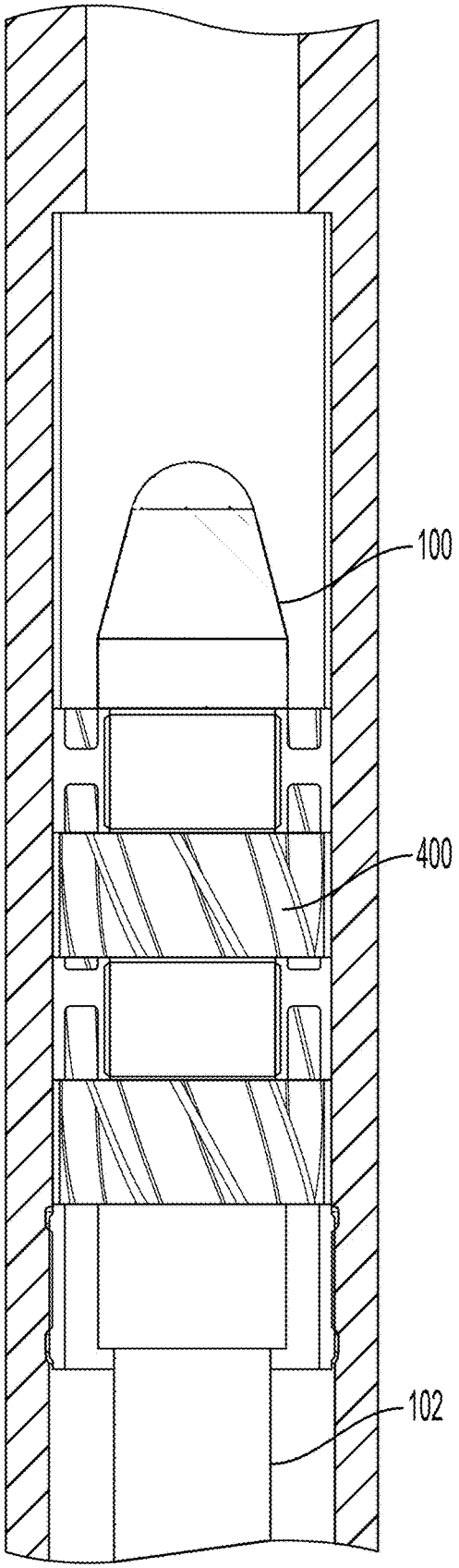
FIG. 14 is a close-up drawing view of FIG. 13.

FIGS. 13 and 14 shows an embodiment of an electronics assembly which uses a turbine 400 to create power for the electronics assembly. The remaining components of the system may be the same as shown in other embodiments.

In yet another embodiment there is a downhole valve and activation and deactivation system including a housing that separates the standpipe flow from the annulus flow. A valve body separates the standpipe flow into two or more flow paths. A valve poppet is received by the valve body in order to alter or modify at least one of the flow paths. There is a linear activation system composed of an electric motor and a ball screw. A sensor measures external stimuli and activates/deactivates the system. A battery powers the sensor and linear activation system. The valve body may be made of a hardened material to prevent or limit wash. The valve poppet may be made of a hardened material to prevent or limit wash. The linear activation system may have a gear box between the electric motor and ball screw to increase the available closing force. The sensor may be one or more of: an accelerometer set up to measure inclination, a magnetometer set up to measure inclination, a pressure sensor that measures annulus pressure, a pressure sensor that measures standpipe pressure, and a thermocouple and measures temperature.

In another embodiment there is a downhole valve and activation/deactivation system for modifying the fluid flow around a power section having a housing that separates the standpipe flow from the annulus flow. A valve body separates the standpipe flow into two paths. The first path is between the rotor and stator of the power section. The second path is through the bore in the rotor. A valve poppet is receivable by the valve body in order to block the second fluid path. A linear activation system includes an electric motor and a ball screw. A sensor measures external stimuli and activates/deactivates the system. A battery powers the sensor and linear activation system. The valve body is made of a hardened material to prevent or limit wash. The valve poppet may be made of a hardened material to prevent or limit wash. The linear activation system may have a gear box between the electric motor and ball screw to increase the available closing force. The sensor may be one or more of: an accelerometer that is set up to measure inclination, a magnetometer that is set up to measure inclination, a pressure sensor that measures annulus pressure, a pressure sensor that measures standpipe pressure, and a thermocouple and measures temperature. The normal position of the valve poppet may be "closed" and the system "opens" the secondary flow path when activated.

In yet another embodiment there is disclosed an activation system for a downhole valve. A rotary driving device converts fluid pressure to rotary motion. There is a valve composed of a rotary component with one or multiple openings and a stationary component with one or multiple openings that will align with the rotary openings for at least a partial rotation of the rotary component relative to the stationary component, thereby varying the total flow area throughout the rotation. A bypass passage extends around or through said valve and said rotary driving device. There is a means for substantially plugging said bypass passage. An electrically activated assembly is capable of both plugging and unplugging said bypass. A sensor initiates the activation in response to a measured parameter reaching a pre-set value. The rotary driving device may operate based on the principles of a Moineau pump. The rotary driving device may be a turbine. The valve may have a portion that is always open, regardless of the relative positions of the stationary and rotary components. The electrically activated assembly may be in the form of an electric motor coupled to a ball screw to create linear motion. The means to plug the bypass passage may be in the form of a poppet valve. The means to plug the bypass passage may be rotating a plate relative to a second plate to modify the available flow passages. The sensor may be one or more of: an inclination sensor in the form of an accelerometer, an inclination sensor in the form of a magnetometer, a flow sensor measuring the flow rate, a pressure sensor that is measuring the annulus pressure, and a pressure sensor that is measuring the standpipe pressure.

In yet another embodiment there is an activation system for a downhole valve including a rotary driving device, a rotary valve, a bypass passage around or through said valve, a means for substantially plugging said bypass passage, and an electrically activated assembly capable of plugging said bypass. A sensor initiates the activation in response to a measured parameter reaching a pre-set value. The rotary driving device may be a Moineau pump. The rotary driving device may be a turbine. The valve may have a portion that is always open, regardless of the relative positions of the stationary and rotary components. The sensor may be one or more of: an inclination sensor in the form of an accelerometer, an inclination sensor in the form of a magnetometer, a flow sensor measuring the flow rate, a pressure sensor that is measuring the annulus pressure, and a pressure sensor that is measuring the standpipe pressure.

In yet another embodiment there is disclosed the use of an electro-magnetic (EM) signal to initiate the activation. There is an activation system for a downhole valve. The activation system includes a rotary driving device, a rotary valve, a bypass passage around or through said valve, a means for substantially blocking said bypass passage, an electrically driven activation device for said means of substantially blocking said passage, and a means to receive an activation command through an electro-magnetic signal. This embodiment may use RFID tags.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. An electrically activatable downhole tool for use during drilling, the downhole tool comprising:

a friction-reducing vibration tool for producing axial vibrations in a drill string, the friction-reducing vibration tool comprising:

a rotary driving device;

a rotary valve, the rotary valve comprising:

a rotary component connected to the rotary driving device, the rotary component having one or more openings, and a stationary component with one or more openings, in which rotation of the rotary component varies alignment of the one or more openings of the rotary component relative to the one or more openings of the stationary component; and a bypass passage defining a flow path around or through the rotary valve; and a downhole valve for use in the drill string, comprising:

a valve body;

a valve poppet within the valve body being axially movable in a direction parallel with the drill string when in use; and an electrically activated linear activation system connected to the valve poppet to move the valve poppet axially, wherein the flow through the bypass passage varies as the valve poppet is moved axially, and wherein variation of the flow through the bypass passage varies a magnitude of axial vibrations generated by the friction-reducing vibration tool.

2. The electrically activatable downhole tool of claim 1, further comprising one or more openings in the valve body that are at least partially covered by the valve poppet when the valve poppet is moved axially.

3. The electrically activatable downhole tool of claim 1, wherein the rotary driving device is a rotor operating based on principles of a Moineau pump and the bypass passage further comprises a bore through the rotor.

4. The electrically activatable downhole tool of claim 3, wherein each of flow through the bypass passage and flow which is diverted away from the bypass passage are contained within the drill string.

5. The electrically activatable downhole tool of claim 3, wherein the friction-reducing vibration tool is in an activated state when the bypass passage is plugged and wherein the friction-reducing vibration tool is in a non-activated state when the bypass passage is unplugged.

6. The electrically activatable downhole tool of claim 1, further comprising:

a sensor for detecting a stimulus; and a processor in communication with the sensor configured to operate the valve poppet in response to signals from the sensor indicative of the stimulus being detected.

7. The electrically activatable downhole tool of claim 6, further comprising a battery connected to the sensor and the processor.

8. The electrically activatable downhole tool of claim 6, wherein the sensor is one or more of: an accelerometer, a magnetometer, a pressure sensor, or a thermocouple.

9. The electrically activatable downhole tool of claim 6 wherein the stimulus is a condition downhole.

10. The electrically activable downhole tool of claim 9 wherein the condition downhole is an indication that the drill string is in a horizontal section of a well.

11. The electrically activatable downhole tool of claim 6, wherein the stimulus is an activation command.

12. The electrically activatable downhole tool of claim 11 wherein the activation command is received while the electrically activatable downhole tool is downhole.

13. The electrically activatable downhole tool of claim 12, wherein axial movement of the valve poppet causes the friction-reducing vibration tool to shift between a non-activated state and an activated state.

14. The electrically activatable downhole tool of claim 13, wherein the processor is configured to move the valve poppet to cause the friction-reducing vibration tool to shift into the non-activated state while the electrically activatable downhole tool is downhole.

15. The electrically activatable downhole tool of claim 13, wherein the processor is configured to move the valve poppet to cause the friction-reducing vibration tool to shift into the activated state while the electrically activatable downhole tool is in a horizontal section of a well.

16. The electrically activatable downhole tool of claim 1, wherein the linear activation system further comprises:

an electric motor; and a ball screw.

17. The electrically activatable downhole tool of claim 1, wherein the valve poppet and valve body comprise tungsten carbide.

18. A method of activating or deactivating a friction-reducing vibration tool for producing axial vibrations in a drill string during drilling, the method comprising:

detecting a stimulus using a sensor; and electrically activating or deactivating the friction-reducing vibration tool based on the detected stimulus, wherein the friction-reducing vibration tool is electrically activated or deactivated by a downhole valve in the drill string, the downhole valve comprising:

a valve body;

a valve poppet within the valve body being axially movable in a direction parallel with the drill string when in use; and an electrically activated linear activation system connected to the valve poppet to move the valve poppet axially, wherein the flow through the flow path varies as the valve poppet is moved axially, and wherein the friction-reducing vibration tool comprises:

a rotary driving device; and a rotary valve, the rotary valve comprising:

a rotary component connected to the rotary driving device, the rotary component having one or more openings, and a stationary component with one or more openings, in which rotation of the rotary component varies alignment of the one or more openings of the rotary component relative to the one or more openings of the stationary component, and a bypass passage defining a flow path around or through the rotary valve, and wherein the friction-reducing vibration tool is electrically activated or deactivated by varying the flow through the bypass passage.

19. The method of claim 18, wherein the detected stimulus is a condition downhole, and the condition downhole is indicative that the drill string is in a horizontal section of a well.

20. The method of claim 19, wherein the friction-reducing vibration tool is activated when the condition downhole indicates that the drill string is in the horizontal section of the well.

21. The method of claim 18, wherein the sensor is one or more of: an accelerometer, a magnetometer, a pressure sensor, or a thermocouple.

22. The method of activating or deactivating a friction-reducing vibration tool of claim 18, wherein the detected stimulus is an activation command.

23. The method of claim 18, further comprising deactivating the friction-reducing vibration tool into a non-activated state in response to the detected stimulus while the electrically activatable downhole tool is downhole.

24. The method of claim 18, wherein the detected stimulus is a condition downhole, and the condition downhole is indicative that the drill string is in a vertical section of a well.

25. The method of claim 24, wherein the friction-reducing vibration tool is deactivated when the condition downhole indicates that the drill string is in the vertical section of the well.

* * * * *